US010697606B1

(12) United States Patent
Fredricks et al.

(10) Patent No.: US 10,697,606 B1
(45) Date of Patent: Jun. 30, 2020

(54) VEHICLE LAMP

(71) Applicant: North American Lighting, Inc., Paris, IL (US)

(72) Inventors: Zachary Brian Fredricks, White Lake, MI (US); Paul Christopher Hawks, Hazel Park, MI (US); Marc Bell, Ann Arbor, MI (US)

(73) Assignee: NORTH AMERICAN LIGHTING, INC., Paris, IL (US)

( * ) Notice: Subject to any disclaimer, the term of this patent is extended or adjusted under 35 U.S.C. 154(b) by 0 days.

(21) Appl. No.: 16/517,099

(22) Filed: Jul. 19, 2019

(51) Int. Cl.

| | |
|---|---|
| ***F21S 41/33*** | (2018.01) |
| ***F21S 41/147*** | (2018.01) |
| ***F21Y 115/10*** | (2016.01) |
| ***F21W 102/13*** | (2018.01) |

(52) U.S. Cl.
CPC ..... *F21S 41/336* (2018.01); *F21S 41/147* (2018.01); *F21W 2102/13* (2018.01); *F21Y 2115/10* (2016.08)

(58) Field of Classification Search
CPC ... F21S 41/336; F21S 41/147; F21Y 2115/10; F21W 2102/13
See application file for complete search history.

(56) References Cited

U.S. PATENT DOCUMENTS

| | | | | |
|---|---|---|---|---|
| 4,704,661 | A * | 11/1987 | Kosmatka | F21S 41/336 362/518 |
| 4,740,875 | A * | 4/1988 | Wyckoff | F21S 41/28 362/336 |
| 6,264,346 | B1 | 7/2001 | Pashley et al. | |
| 6,505,961 | B2 | 1/2003 | Natsume | |
| 7,108,412 | B2 | 9/2006 | Ishida et al. | |
| 7,301,095 | B2 | 11/2007 | Murphy et al. | |
| 9,441,813 | B2 * | 9/2016 | Schmid | B60Q 1/0041 |
| 9,616,811 | B2 * | 4/2017 | Hulse | B60Q 1/2611 |
| 2014/0133169 | A1 | 5/2014 | Schwaiger et al. | |
| 2016/0201865 | A1 * | 7/2016 | Woodward | F21S 41/19 362/516 |
| 2018/0045394 | A1 * | 2/2018 | Bolander, Jr. | F21S 41/336 |
| 2018/0058653 | A1 * | 3/2018 | Alisafaee | F21S 43/15 |

FOREIGN PATENT DOCUMENTS

| | | |
|---|---|---|
| EP | 0849523 A2 | 6/1998 |
| EP | 2679888 B1 | 1/2016 |
| EP | 2947384 B1 | 8/2017 |

* cited by examiner

*Primary Examiner* — Mary Ellen Bowman
(74) *Attorney, Agent, or Firm* — Brooks Kushman P.C.

(57) ABSTRACT

A vehicle lamp is provided with an upper light source and a lower light source spaced apart from the upper light source in a height direction. A reflector has a central optical axis extending a forward direction and oriented between the upper and lower light source. The reflector has first and second arrays of reflective surfaces. The first array of first reflective surfaces reflects light emitted from the upper light source in a first light pattern in the direction of the central optical axis. The second array of second reflective surfaces reflecting light emitted from the lower light source in a second light pattern in the direction of the central optical axis. At least one of the first reflective surfaces is oriented between two second reflective surfaces in the height direction.

20 Claims, 3 Drawing Sheets

VEHICLE LAMP

TECHNICAL FIELD

The present application relates to a vehicle lamp for emitting light in a predetermined pattern and/or direction.

BACKGROUND

A vehicle headlamp is generally configured to allow switching between a low-beam and a high-beam function. For each beam function, typical vehicle headlamps require separate reflector cavities. However, when separate low-beam and high-beam reflector cavities are configured independently, a vehicle headlamp may become considerably larger, contributing to increased cost and reduced efficiency.

SUMMARY

According to at least one embodiment, a vehicle lamp is provided having an upper light emitting diode (LED) mounted adjacent an upper portion of a lamp chamber and a lower LED is mounted adjacent a lower portion of the lamp chamber. A reflector has a first and second array of reflective surfaces. The first array of first reflective surfaces reflect light emitted from the upper LED toward a front of the headlamp in a low-beam pattern. The second array of second reflective surfaces reflecting light emitted from the lower LED toward the front of the headlamp in a high-beam pattern. The first and second reflective surfaces are arranged to alternate from the upper portion to the lower portion of the lamp chamber along a height of the reflector.

In another embodiment, each of the first reflective surfaces is inclined in a rearward direction with an upper first edge being rearward from a lower first edge. Each of second first reflective surfaces is inclined in a forward direction with an upper second edge being forward from a lower second edge.

In another embodiment, each of the second reflective surfaces is offset rearward from the lower edge of the first reflective surface by a ledge surface.

In another embodiment, the first reflective surfaces block light from the lower LED from being incident on the second reflective surfaces.

In another embodiment, the headlamp comprises two lower LEDs spaced apart in a width direction and two upper LEDs spaced apart in the width direction.

In another embodiment, the reflector has a depth less than 30 centimeters, and wherein the focal length of each of the first and second reflective surfaces is greater than 60 millimeters.

According to at least one embodiment, a headlamp is provided with an upper light source and a lower light source spaced apart from the upper light source in a height direction. A reflector has a central optical axis extending a forward direction and oriented between the upper and lower light source. The reflector has first and second arrays of reflective surfaces. The first array of first reflective surfaces reflects light emitted from the upper light source in a first light pattern in the direction of the central optical axis. The second array of second reflective surfaces reflecting light emitted from the lower light source in a second light pattern in the direction of the central optical axis. At least one of the first reflective surfaces is oriented between two second reflective surfaces in the height direction.

In another embodiment, the first and second reflective surfaces are arranged to alternate in the height direction so that an upper edge of each of the first reflective surfaces is adjacent a lower edge of each of the second reflective surfaces.

In another embodiment, the first and second reflective surfaces are arranged in alternating inclination, wherein each of the first reflective surfaces is inclined in a rearward direction with an upper first edge being rearward from a lower first edge. Each of second first reflective surfaces is inclined in a forward direction with an upper second edge being forward from a lower second edge.

In another embodiment, the first and second arrays extend generally linearly in a width direction transverse to the height direction.

In another embodiment, the first array defines the first light pattern having a low-beam pattern. The first array defines the first light pattern having a high-beam pattern with at least a portion of the high-beam pattern extending above the low-beam pattern in the height direction.

In another embodiment, the first and second arrays of reflective surfaces are formed integrally with one another.

According to at least one embodiment, a vehicle lamp has a first light source and a second light source spaced apart from the first light source in a first direction. A reflector has a central optical axis oriented between the first and second light sources in the first direction. The reflector has first and second arrays of reflective surfaces. The first array of first reflective surfaces reflects light emitted from the first light source in a first light pattern along the central optical axis. The second array of second reflective surfaces reflects light emitted from the second light source in a second light pattern along the central optical axis, the second light pattern being different than the first light pattern. The first and second reflective surfaces have alternating inclination in the first direction.

In another embodiment, the first and second light sources comprise light emitting diodes (LEDs) each having an optical axis directed rearward toward the reflector.

In another embodiment, the first and second reflective surfaces each have a far edge positioned a greater distance in the first direction from the light source and a near edge positioned closer to the light source than the far edge, wherein each of the far edges are oriented more forward than the near edges.

In another embodiment, the first and second arrays extend generally linearly in a second direction transverse to the first direction.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Reflectors designed for high-beam and-low beam automotive applications try to tightly control light output and beam pattern for improved performance and range while meeting regulations. A wide reflector improves the photometric output and the capture rate from the light source. However, vehicle styling and packaging constrains limit the size of the reflector.

Figure 1:
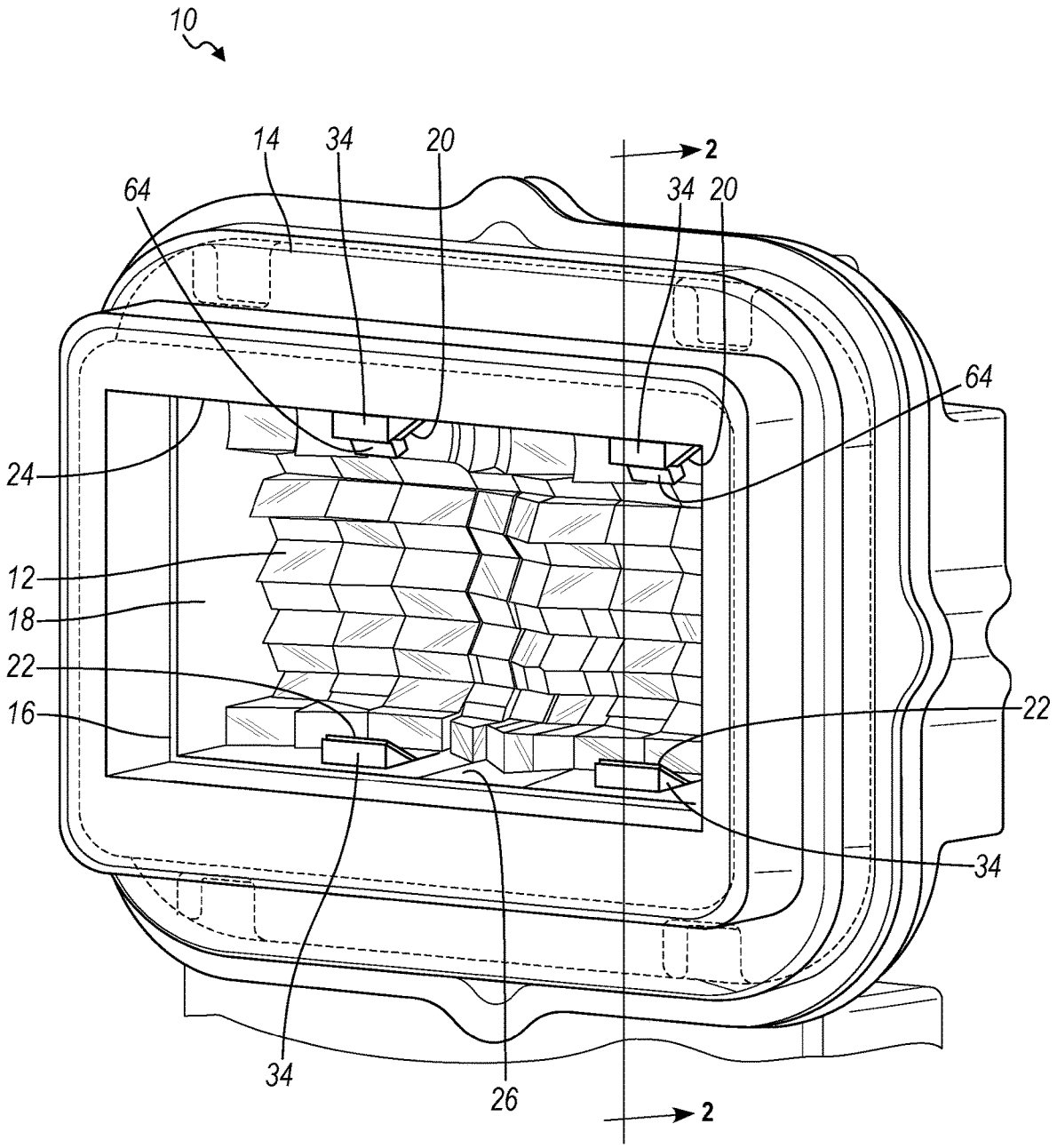
FIG. 1 is a front perspective view of a lamp for a vehicle according to one non-limiting embodiment.

The vehicle lamp of the present application minimizes the width of the reflector while still providing improved light output for both high beam and low beam patterns. FIG. 1 illustrates a vehicle lamp 10 having a reflector 12 for providing a first light distribution pattern, such as a low-beam pattern for a headlamp, and a second light distribution pattern, such as a high-beam pattern. The first light distribution pattern may be directed more downward and may have a horizontal cutoff line so as not to produce glare to a driver in an oncoming car and comply with safety standards. The second light distribution pattern may provide a higher, brighter and/or wider pattern with more intensity providing better visibility at a greater distance. As such, at least a portion of the high-beam pattern extends above the low-beam pattern.

The vehicle lamp 10 has a lamp housing 14 enclosed with an outer transparent lens disposed over a forward opening 16. While FIG. 1 illustrates a headlamp as one example of a vehicle lamp, the lamp 10 may be any vehicle lamp requiring varying light distribution patterns, such as a rear combination lamp, tail lamp or marker lamp, for example. The forward opening and a forward direction define a light emitting direction of the vehicle lamp. A lamp chamber 18 is defined between the housing 14 and the lens and the reflector 12 is mounted inside the lamp chamber 18.

Figure 3:
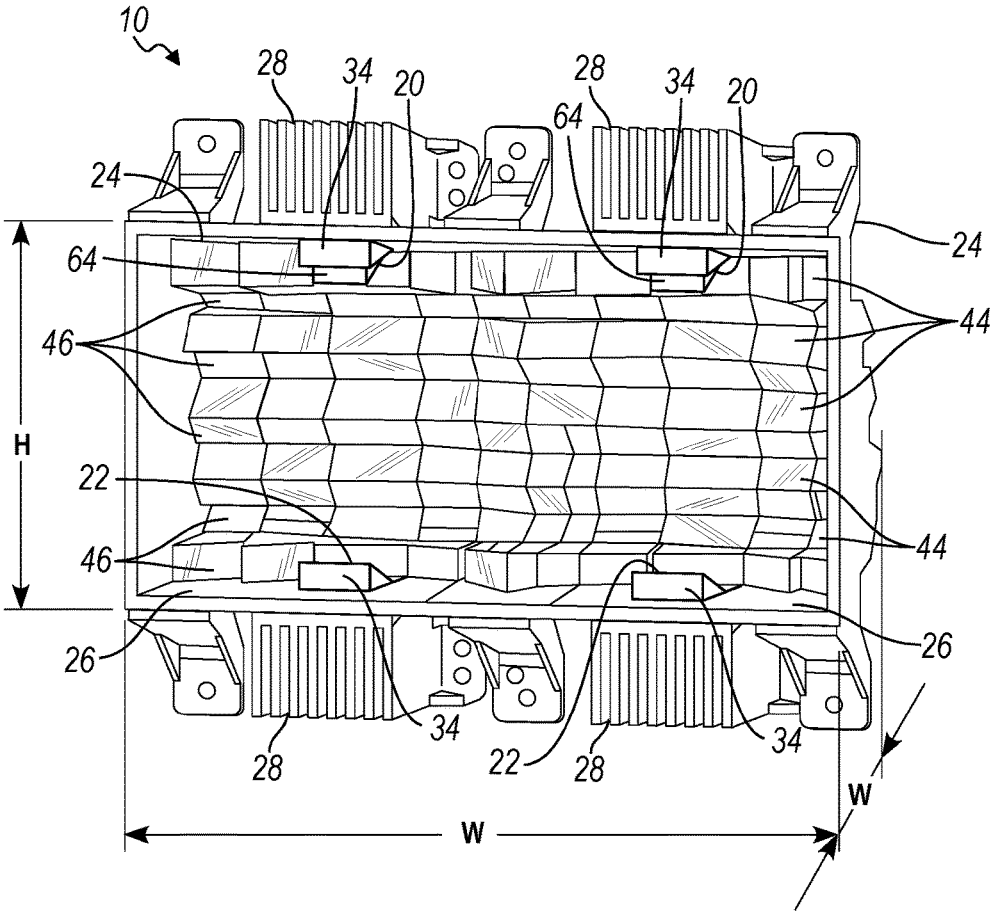
FIG. 3 is a perspective view showing of a portion of the lamp in FIG. 1.

As shown in FIG. 3, a first light source 20 is mounted adjacent an upper portion or upper surface 24 of a lamp chamber 18 A second light source 22 is spaced apart from the first light source 20 and is mounted adjacent to a lower portion or lower surface 26 of the lamp chamber 18. The upper and lower light sources 20, 22 may be mounted to heat sinks 28 that conduct heat away from the light sources 20, 22. The heat sinks 28 may include a mounting tab positioned within the lamp chamber 18 to orient the light sources 20, 22 relative to the reflector 12. The heat sink mounting tab 28 may block the light sources 20, 22 from being visible from the forward viewing direction. The heat sink 28 may extend to outside the lamp chamber 18 to conduct heat away from light sources and lamp chamber.

The upper and lower light sources 20, 22 may be a semiconductor light emitting unit, such as a light emitting diode (LED) in which a rectangular light emitting chip emitting a generally hemispherical light distribution. The chip may covered with a hemispherical molded lens. The LEDs may be mounted to a substrate or circuit board which is secured to the mounting tab of the heat sinks 28. Other suitable light sources may be used such as laser diodes, bulbs or suitable light emitting elements known to a person of ordinary skill in the art.

The reflector 12 is mounted in the lamp chamber 18 rearward of the light sources 20, 22. As shown in the exploded view of the reflector 12 in FIG. 4, the reflector has a first array 30 of reflective surfaces 40, and a second array 32 of reflective surfaces 42. The first and second reflective surfaces 40, 42 are interwoven to alternate from the upper portion to the lower portion of the light chamber along a height of the reflector.

Figure 2:
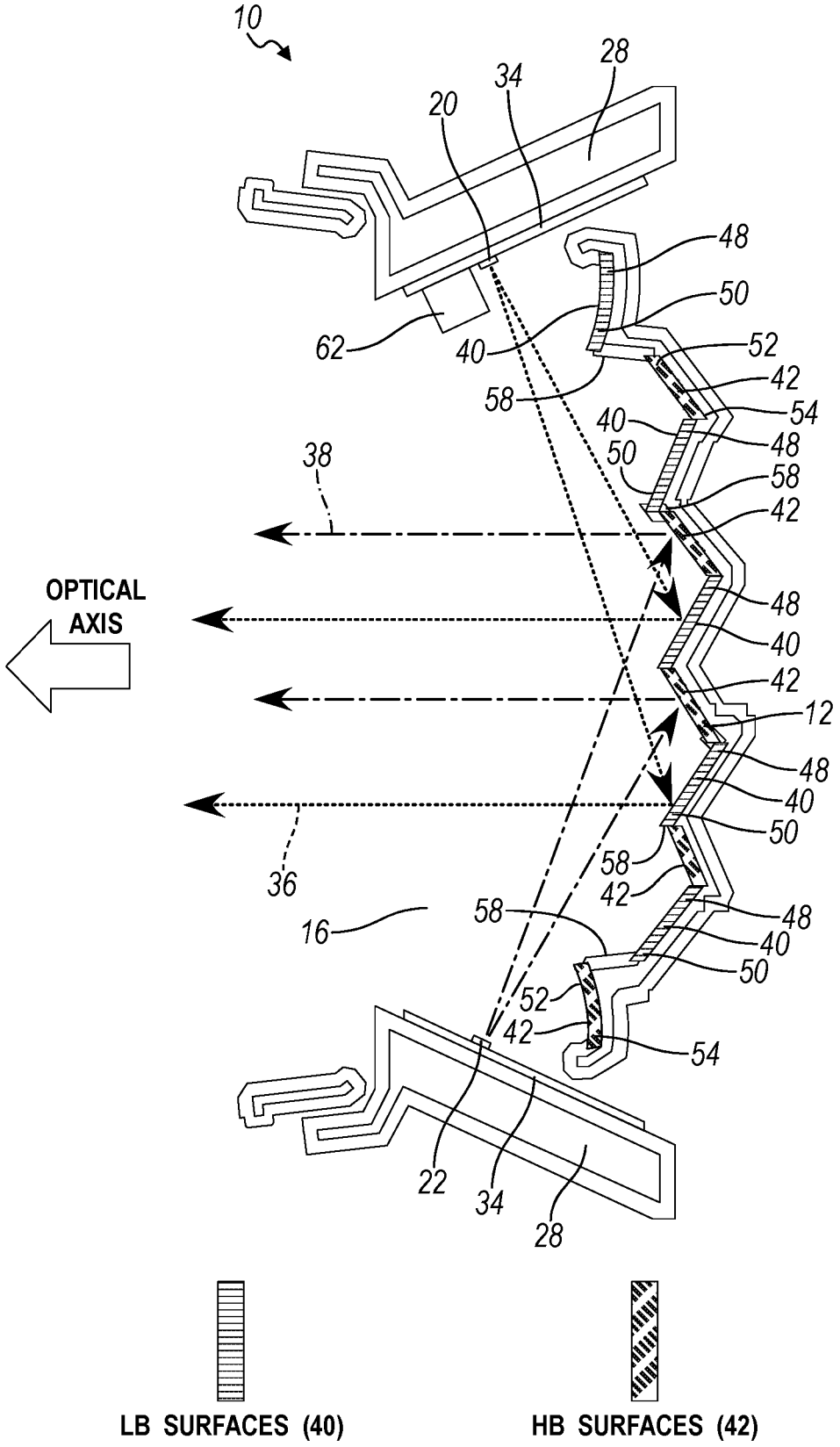
FIG. 2 is a sectional view taken along a line 2-2 in FIG. 1 showing the ray traces of the light emitted from the light sources.

As shown in FIG. 2, the first array 30 reflects light emitted from the upper light source 20 toward the front of the lamp in the first light distribution pattern 36. The second array 32 reflects light emitted from the lower light source 22 toward the front of the lamp in the second light distribution pattern 38.

The first and second arrays 30, 32 of reflective surfaces 40, 42 are formed integrally with one another on the reflector 12. For example, the first and second arrays 30, 32 of the reflector 12 may be integrally molded of plastic and metallized. By arranging the first reflective surfaces 40 between two second reflective surfaces 42, a compact reflector system is achieved. The lamp 10 is not required to have separate cavities of reflectors or blocking walls between separate cavities. As shown in FIGS. 1 and 3, the first and second arrays 30, 32 are formed on the same reflector and the first reflective surfaces 40 are spaced apart in the height direction by the second reflective surfaces 42. As such, the lamp 10 has a narrow width with maximal output per unit of active surface area of the reflector and inactive area on the reflector is minimized.

The first and second arrays 30, 32 are generally linear arrays 44, 46 in a width direction W of the lamp. The linear arrays 44, 46 may have facets with parabolic contours in a height and width direction depth direction and may also have contours for spread parameters, for example. In the front view, the arrays are generally linear in the width direction of the lamp and each facet appears generally rectangular when viewed from the front.

In the height direction H, the first and second reflective surfaces 40, 42 have alternating inclination. Each of the first reflective surfaces 40 is inclined in a rearward direction, and each of the second reflective surfaces 42 is inclined in a forward direction. Each of the first reflective surfaces 40 is inclined in the rearward direction with an upper first edge 48 being rearward from a lower first edge 50. Each of second first reflective surfaces 42 is inclined in the forward direction with an upper second edge 52 being forward from a lower second edge 54.

Each of the second reflective surfaces 42 is offset from the lower edge 50 of the first reflective surface 40 by a ledge surface 58. The first reflective surfaces 40 block light emitted from the first light source 20 from being incident on the second reflective surfaces 42. For example, several of the second reflective surfaces 42 are offset rearward from the first lower edge 50 by the ledge surface 58. The ledge surface 58 may not be reflective and may extend in a direction generally parallel to the optical axis.

Having the second reflective surfaces 42 slightly offset from the first reflective surfaces 40 ensures that light from the first light source 20 is blocked from the second reflective surfaces 42. This provides the vehicle lamp 10 with a unique lit curb appeal look with a blinders design having alternating rows of lit/unlit reflective surfaces based on the selected light-pattern mode. For example, when the first LED emits light to form the low-beam pattern, the first reflective surfaces 40 are 'lit' while the second reflective surfaces are shadowed, or 'unlit.' This provides the curb appeal look of lit lines of the first array 30. When the high-beam pattern is required, the second reflective surfaces 42 are lit while the first reflective surfaces also remain lit. The light sources 20, 22 also do not require light shields or cavity walls to prevent emitted light from contacting undesirable portions of a reflector. The first light source 20 used to form the low-beam pattern may include a light shade 62 that blocks light emitted in the forward direction that is not directly incident on the reflector 12.

Figure 4:
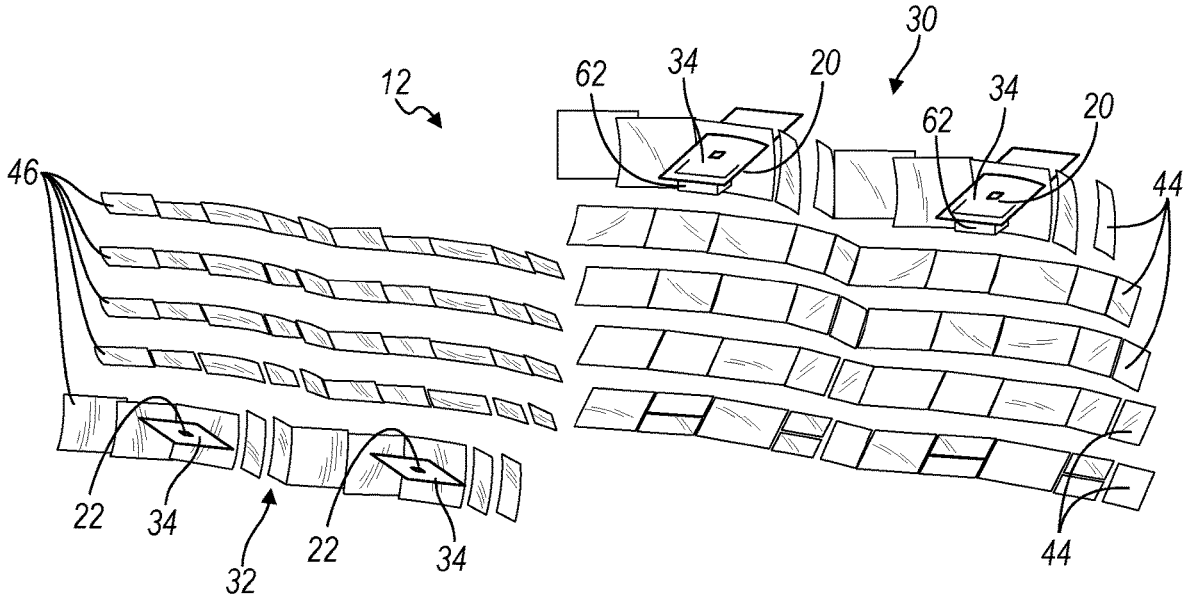
FIG. 4 is an exploded view of a portion of the lamp in FIG. 1.

As shown in FIGS. 1 and 3-4, the lamp 10 may have two upper light sources 20 and two lower light sources 22. Each of the pair of lower and upper light sources 20, 22 is spaced apart in a width direction W that is transverse to the height direction H. Even with the pairs of upper and lower light sources 20, 22, the reflector does not have separate cavities for the varying light patterns.

Alternating the first and second reflector arrays 30, 32 provides several additional advantages. Firstly, the overall size of the lamp 10 is more compact. For example, the overall width W may be 220 millimeters (mm). In another embodiment, the width may be less than 250 mm. Of course, different widths may be required for styling or different output requirements of different lamps. A typical lamp having high beam and low beam cavities requires a greater width to similar light output requirements.

The alternating reflectors arrays 30, 32 also allow compactness in the direction of the optical axis and allow the reflective surfaces 40, 42 to have relatively longer focal lengths than typical vehicle lamps. For example, the maximum focal length may be approximately 90 mm. In another embodiment, the focal length may be greater than 60 mm. A typical lamp has a shorter focal length. Longer focal lengths allow for more variation and tolerance errors in mounting of the LED and reflector. A longer focal also reduces image size, allowing tight control of light reflected which can help make more uniform road appearance and increase the down-road lit range of the lamp. Of course, different focal lengths may be required for styling or different output requirements of different lamps. As a result, the overall depth D of the reflector 12 and lamp is relatively narrow. The depth may be approximately 20 mm. In another embodiment, the depth may be less than 30 mm. A typical lamp may have a depth that is 2-3 times the depth of the lamp of the present application.

The first and second reflective surfaces 40, 42 for the respective first and second light distribution patterns 36, 38 may have the same optical center, where the optical center defines lamp properties such as height from ground and width from the opposite lamp. Having the same optical center is helpful in complying with performance and safety regulations. Also, having the high-beam reflector and low-beam reflector in a single cavity saves costs associated with aiming devices for high-beam optics relative the low beam cutline, for example.

The first and second arrays 30, 32 where the reflective surfaces 40, 42 are alternated may be used for lamps requiring output in other dimensions or directions. For example, the first and second arrays 30, 32 may be used in low-output, high illuminance area applications such as rear-combination lamps that provide turn signal and brake indicator function together in one lamp housing.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A headlamp comprising:

an upper light emitting diode (LED) mounted adjacent an upper portion of a lamp chamber;

a lower LED mounted adjacent a lower portion of the lamp chamber; and a reflector comprising:

a first array of first reflective surfaces reflecting light emitted from the upper LED toward a front of the headlamp in a low-beam pattern; and a second array of second reflective surfaces reflecting light emitted from the lower LED toward the front of the headlamp in a high-beam pattern, wherein the first and second reflective surfaces are arranged to alternate from the upper portion to the lower portion of the lamp chamber along a height of the reflector.

2. The headlamp of claim 1, wherein each of the first reflective surfaces is inclined in a rearward direction with an upper first edge being rearward from a lower first edge; and wherein each of second first reflective surfaces is inclined in a forward direction with an upper second edge being forward from a lower second edge.

3. The headlamp of claim 2, wherein each of the second reflective surfaces is offset rearward from the lower edge of the first reflective surface by a ledge surface.

4. The headlamp of claim 1, wherein the first reflective surfaces block light from the lower LED from being incident on the second reflective surfaces.

5. The headlamp of claim 1, wherein the headlamp comprises two lower LEDs spaced apart in a width direction and two upper LEDs spaced apart in the width direction.

6. The headlamp of claim 1, wherein the reflector has a depth less than 30 centimeters, and wherein the focal length of each of the first and second reflective surfaces is greater than 60 millimeters.

7. A headlamp comprising:

an upper light source;

a lower light source spaced apart from the upper light source in a height direction; and a reflector having a central optical axis extending a forward direction and oriented between the upper and lower light source, the reflector comprising:

a first array of first reflective surfaces reflecting light emitted from the upper light source in a first light pattern in the forward direction of the central optical axis; and a second array of second reflective surfaces reflecting light emitted from the lower light source in a second light pattern in the forward direction of the central optical axis, wherein at least one of the first reflective surfaces is oriented between two second reflective surfaces in the height direction.

8. The headlamp of claim 7, wherein the first and second reflective surfaces are arranged to alternate in the height direction so that an upper edge of each of the first reflective surfaces is adjacent a lower edge of each of the second reflective surfaces.

9. The headlamp of claim 8, wherein the first and second reflective surfaces are arranged in alternating inclination, wherein each of the first reflective surfaces is inclined in a rearward direction with an upper first edge being rearward from a lower first edge, and wherein each of second first reflective surfaces is inclined in the forward direction with an upper second edge being forward from a lower second edge.

10. The headlamp of claim 8, wherein each of the second reflective surfaces is offset rearward from the lower edge of the first reflective surface by a ledge surface.

11. The headlamp of claim 7, wherein the first reflective surfaces block light emitted from the first light source from being incident on the second reflective surfaces.

12. The headlamp of claim 7, wherein the first and second arrays extend generally linearly in a width direction transverse to the height direction.

13. The headlamp of claim 7, wherein the first array defines the first light pattern having a low-beam pattern; and wherein the first array defines the first light pattern having a high-beam pattern with at least a portion of the high-beam pattern extending above the low-beam pattern in the height direction.

14. The headlamp of claim 7, wherein the first and second arrays of reflective surfaces are formed integrally with one another.

15. A vehicle lamp comprising:

a first light source;

a second light source spaced apart from the first light source in a first direction; and a reflector having a central optical axis oriented between the first and second light sources in the first direction, the reflector comprising:

a first array of first reflective surfaces reflecting light emitted from the first light source in a first light pattern along the central optical axis; and a second array of second reflective surfaces reflecting light emitted from the second light source in a second light pattern along the central optical axis, the second light pattern being different than the first light pattern, wherein the first and second reflective surfaces have alternating inclination in the first direction.

16. The vehicle lamp of claim 15, wherein the first and second light sources comprise light emitting diodes (LEDs) each having an optical axis directed rearward toward the reflector.

17. The vehicle lamp of claim 15, wherein the first reflective surfaces each have a far edge positioned a greater distance in the first direction from the first light source and a near edge positioned closer to the first light source than the far edge, wherein each of the far edges are oriented more forward than the near edges.

18. The vehicle lamp of claim 17, wherein each of the second reflective surfaces is offset from the near edge of the first reflective surface by a ledge surface.

19. The vehicle lamp of claim 15, wherein the first reflective surfaces block light from the first light from being incident on the second reflective surfaces.

20. The vehicle lamp of claim 15, wherein the first and second arrays extend generally linearly in a second direction transverse to the first direction.

* * * * *